US006227538B1

(12) United States Patent
Kniss

(10) Patent No.: US 6,227,538 B1
(45) Date of Patent: May 8, 2001

(54) PAPER TAMPING MECHANISM

(75) Inventor: James Kniss, Chester, CT (US)

(73) Assignee: GBR Systems Corporation, Chester, CT (US)

( * ) Notice: Subject to any disclaimer, the term of this patent is extended or adjusted under 35 U.S.C. 154(b) by 0 days.

(21) Appl. No.: 09/294,624

(22) Filed: Apr. 19, 1999

(51) Int. Cl.[7] ..... B65H 31/26

(52) U.S. Cl. ..... 271/220; 271/210

(58) Field of Search ..... 271/220, 221, 271/210, 207

(56) References Cited

U.S. PATENT DOCUMENTS

| | | |
|---|---|---|
| 197,477 | 11/1877 | Kneeland . |
| 281,150 | 7/1883 | Smith et al. . |
| 470,898 | 3/1892 | Reiffel . |
| 899,133 | 9/1908 | Ranz . |
| 1,032,378 | 7/1912 | Chandler . |
| 1,086,353 | 2/1914 | Dick . |
| 1,236,181 | 8/1917 | Kast . |
| 1,448,705 | 3/1923 | Chisholm . |
| 1,478,464 | 12/1923 | Waters . |
| 1,528,450 | 3/1925 | Neckerman . |
| 1,573,414 | 2/1926 | Mahoney . |
| 1,595,384 | 8/1926 | Cochran . |
| 1,617,874 | 2/1927 | Swanson . |
| 1,685,873 | 10/1928 | Evans et al. . |
| 1,712,808 | 5/1929 | Bing . |
| 1,887,023 | 11/1932 | Hunziker . |
| 2,005,370 | 6/1935 | Hughey . |
| 2,094,665 | 10/1937 | Mudd . |
| 2,157,228 | 5/1939 | Buccicone et al. . |
| 2,162,889 | 6/1939 | Hormel . |
| 2,215,091 | 9/1940 | Adatte et al. . |
| 2,228,887 | 1/1941 | Peterson . |
| 2,332,600 | 10/1943 | Rapp . |
| 2,406,489 | 8/1946 | Case . |
| 2,461,418 | 2/1949 | Ford . |
| 2,472,931 | 6/1949 | Yohn . |
| 2,533,422 | 12/1950 | Braun . |
| 2,561,015 | 7/1951 | Davidson . |
| 2,606,669 | 8/1952 | Morrison . |
| 2,626,800 | 1/1953 | Martin . |
| 2,635,002 | 4/1953 | Davidson et al. . |
| 2,640,605 | 6/1953 | Chatterton . |
| 2,733,064 | 1/1956 | Martin . |
| 2,753,185 | 7/1956 | Johnson . |
| 2,760,809 | 8/1956 | Mallin . |
| 2,761,682 | 9/1956 | Buccicone . |
| 2,805,858 | 9/1957 | Hayes . |
| 2,844,373 | 7/1958 | Van Marle . |
| 2,850,281 | 9/1958 | Heimlicher et al. . |
| 2,887,863 | 5/1959 | Cooper . |
| 2,893,254 | 7/1959 | Grover . |
| 2,938,721 | 5/1960 | Buckingham et al. . |
| 2,944,813 | 7/1960 | Smith . |
| 3,051,479 | 8/1962 | Gore . |
| 3,095,192 | 6/1963 | Simjian . |
| 3,180,190 | 4/1965 | Haselow . |
| 3,198,519 | 8/1965 | Bartsch . |

(List continued on next page.)

FOREIGN PATENT DOCUMENTS

| | | | | |
|---|---|---|---|---|
| 2504971 | * | 8/1976 | (DE) | 271/210 |
| 360056766 | * | 4/1985 | (JP) | 271/220 |
| 0261161 | * | 10/1989 | (JP) | 271/207 |
| 3843281 | * | 6/1990 | (JP) | 271/220 |

*Primary Examiner*—H. Grant Skaggs
(74) *Attorney, Agent, or Firm*—Joseph J. Previto

(57) ABSTRACT

A paper tamping mechanism comprising a mechanism depositing sheets in a stack; a tamping blade adjacent to the stack; said tamping blade is movable towards said stack in order to strike and tamp a sheet deposited on the stack; the tamping blade means is movable away from the stack after the sheet has been struck; a magnet is mounted on the blade and a plurality of magnets are provided adjacent to the blade in a wheel which moves magnets relative to said magnet in the blade.

21 Claims, 2 Drawing Sheets

U.S. PATENT DOCUMENTS

| | | | | |
|---|---|---|---|---|
| 3,278,178 | | 10/1966 | Eckl . | |
| 3,307,716 | | 3/1967 | Ross . | |
| 3,334,895 | | 8/1967 | Daniels et al. . | |
| 3,367,652 | | 2/1968 | Stobb . | |
| 3,438,309 | | 4/1969 | Boileau . | |
| 3,556,511 | | 1/1971 | Howard et al. . | |
| 3,556,513 | | 1/1971 | Howard . | |
| 3,565,420 | | 2/1971 | Howard . | |
| 3,672,663 | | 6/1972 | Tomlinson . | |
| 3,782,591 | | 1/1974 | Fries . | |
| 3,804,514 | | 4/1974 | Jasinski . | |
| 3,815,896 | | 6/1974 | Hoyer . | |
| 3,847,388 | * | 11/1974 | Lynch | 271/220 |
| 3,858,732 | | 1/1975 | Kemper . | |
| 3,862,752 | | 1/1975 | Totten . | |
| 3,869,116 | | 3/1975 | Kroeker . | |
| 3,910,570 | | 10/1975 | Bleau . | |
| 3,918,700 | | 11/1975 | Donner . | |
| 4,033,579 | | 7/1977 | Stange et al. . | |
| 4,043,460 | | 8/1977 | Steele . | |
| 4,076,408 | | 2/1978 | Reid et al. . | |
| 4,138,102 | | 2/1979 | Palmer . | |
| 4,164,347 | | 8/1979 | McGrain . | |
| 4,169,674 | | 10/1979 | Russel . | |
| 4,189,133 | | 2/1980 | Arrasmith et al. . | |
| 4,219,192 | | 8/1980 | Burke . | |
| 4,221,378 | | 9/1980 | Kamath et al. . | |
| 4,231,562 | | 11/1980 | Hori . | |
| 4,334,674 | | 6/1982 | Ishii . | |
| 4,372,547 | | 2/1983 | Yanagawa et al. . | |
| 4,405,123 | | 9/1983 | Takeyama et al. . | |
| 4,440,387 | | 4/1984 | Ikoma et al. . | |
| 4,469,320 | | 9/1984 | Wenthe, Jr. . | |
| 4,575,067 | | 3/1986 | Ciatteo . | |
| 4,611,741 | | 9/1986 | Wilson . | |
| 4,611,800 | | 9/1986 | Parsons et al. . | |
| 4,639,128 | | 1/1987 | Anderson . | |
| 4,768,912 | | 9/1988 | Miura . | |
| 5,026,034 | * | 6/1991 | Russel et al. | 271/220 |

* cited by examiner

PAPER TAMPING MECHANISM

BACKGROUND

The present invention relates to a paper tamping mechanism and more particularly to a paper tamping mechanism which assures that sheets deposited on a stack of sheets are tamped down so that the uppermost sheet lies flat on the stack.

Handling of paper sheets often involves depositing individual sheets of paper in an accumulating area. The sheets are deposited one on top of the other to form a stack in the accumulating area. Since the individual sheets are light and are fed from a source spaced from the accumulating area, the sheet being deposited sometimes may not lie flat on the stack. If this occurs, it may interfere with the transfer of the stack of sheets to some other unit or with some additional function the stack may be subjected to.

OBJECTS

The present invention avoids this problem and has for one of its objects the provision of an improved paper tamping mechanism for assuring that the topmost sheet deposited on a stack will be tamped down so that it will lie flat on the stack.

Another object of the present invention is the provision of an improved paper tamping mechanism which is operated with a minimum of moving parts.

Another object of the present invention is the provision of an improved paper tamping mechanism which is simple to operate and inexpensive to manufacture.

Other and further objects will be obvious upon the understanding of the illustrative embodiment about to be described, or which will be indicated in the appended claims, and various advantages not referred to herein will occur to one skilled in the art upon employment of the invention in practice.

These objects are accomplished by providing a tamping blade adjacent the stack which moves down to strike the topmost sheet as soon as it is deposited on the stack in order to flatten the sheet on top of the stack. In the preferred embodiment of the invention, the tamping blade has a permanent magnet therein which reacts with permanent magnets on a rotatable magnetic wheel or cylinder adjacent thereto. The permanent magnet in the tamping blade is of one polarity and the permanent magnets in the magnetic wheel are alternately magnets with positive and negative polarities. When the magnetic wheel is rotated, as soon as the permanent magnet on the wheel with a polarity the same as the polarity of the permanent magnet in the tamping blade are adjacent to each other, the magnets repel each other and the tamping blade will move down and strike the topmost sheet in order to lay it perfectly flat on the stack. As the magnetic wheel continues to rotate and a permanent magnet in the wheel of a polarity different from the polarity of the tamping blade magnet are adjacent to each other, the magnets will attract each other and the tamping blade will move up away from the stack in order to permit another sheet to be deposited on top of the stack.

DRAWINGS

A preferred embodiment of the invention has been chosen for purposes of illustration and description and is shown in the accompanying drawings forming a part of the specification wherein.

DESCRIPTION

Figure 1:
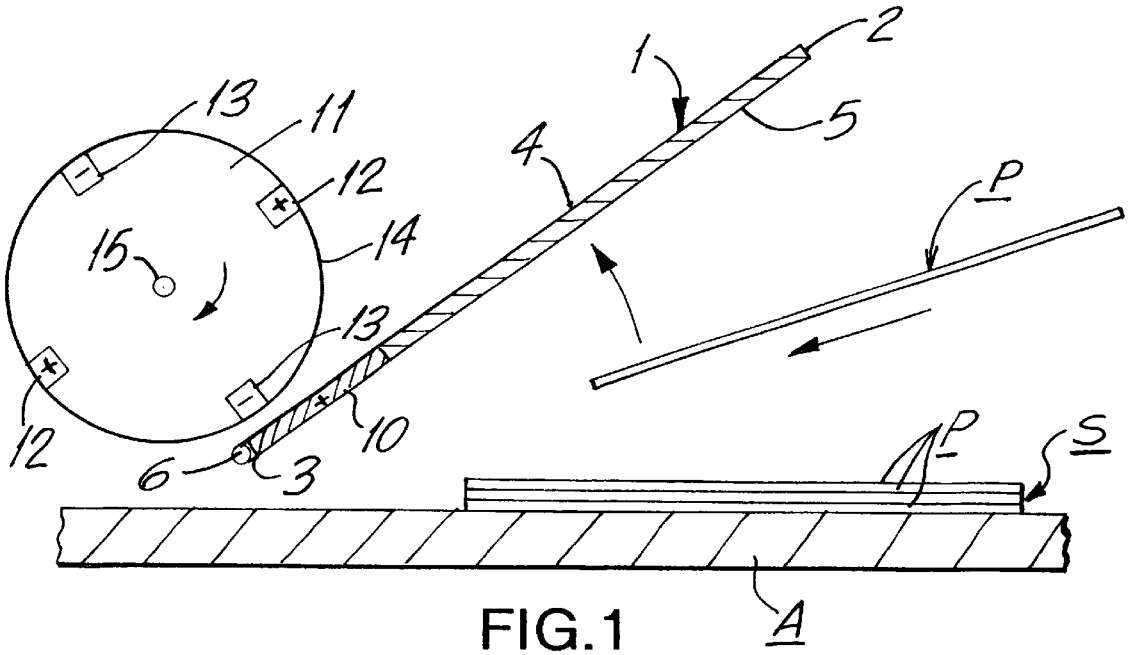
FIG. 1 is a simplified and diagrammatic side view of a tamping mechanism made in accordance with the present invention showing the tamping blade being moved away from the stack.
Figure 2:
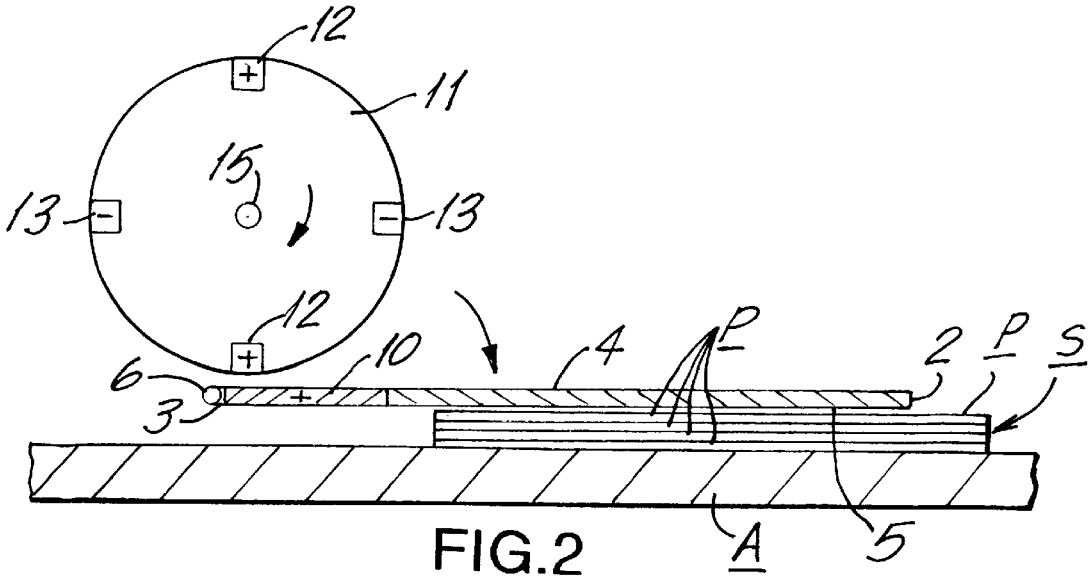
FIG. 2 is a view similar to FIG. 1 showing the tamping blade being moved toward the stack.
Figure 3:
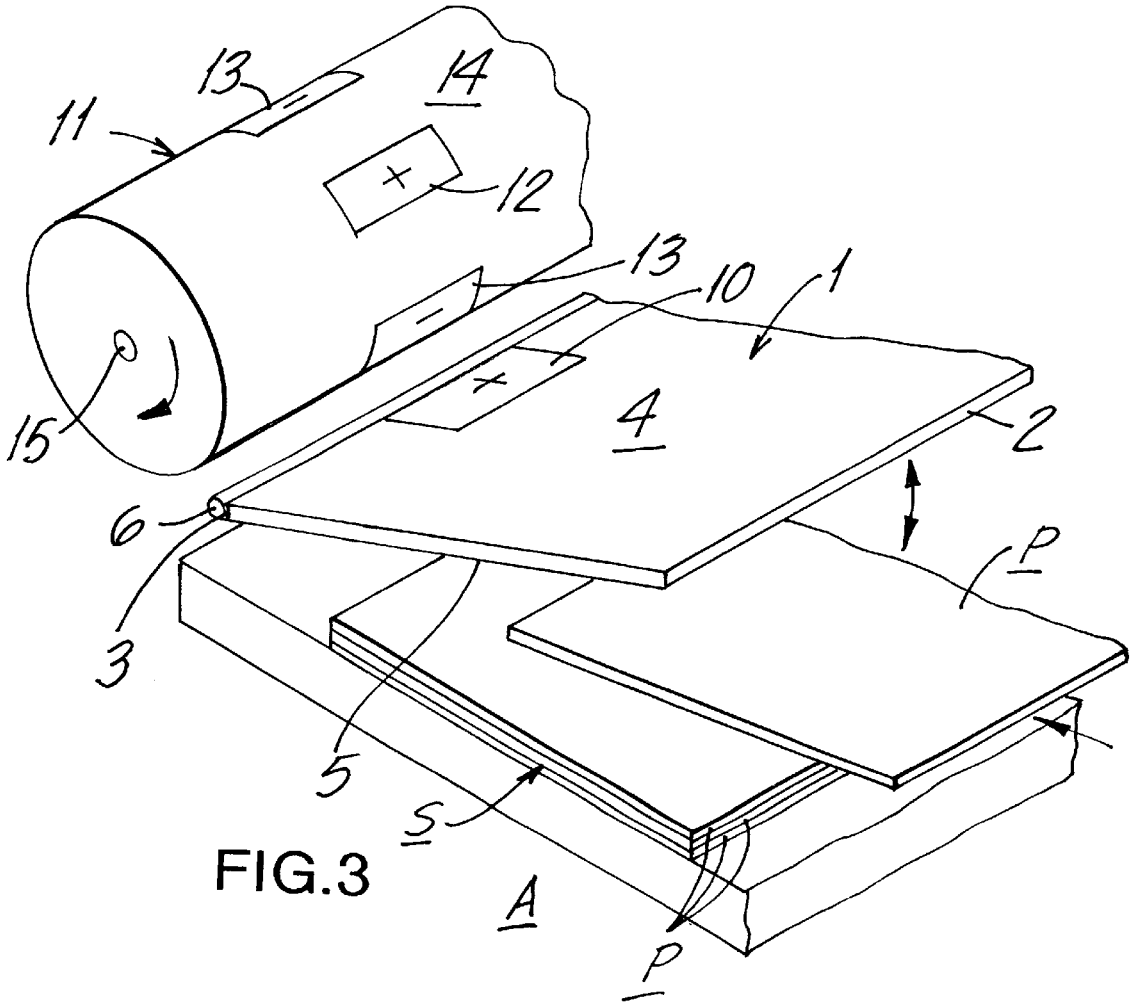
FIG. 3 is a simplified and diagrammatic perspective view of the tamping mechanism of the present invention.

Referring to the drawings, sheets of paper P are delivered by any well known means one by one on top of each other onto an accumulating area A to form a stack S of sheets P. Since the topmost sheet P is dropped onto the stack S from a source (not shown), the sheet P may not lie flat on top of the stack S. In order to prevent this, a tamping blade 1 is pivotally mounted adjacent the stack S. The tamping blade 1 is flat, thin and elongated and has a top face 4, a bottom face 5, front edge 2 and a rear edge 3. The tamping blade 1 is pivotally mounted along its rear edge 3 to a pivot 6 which permits the tamping blade 1 to move up and down around the pivot 6. As soon as a sheet P is deposited on top of the stack S, the tamping blade 1 is moved down around pivot mechanism 6 so that it strikes the topmost sheet P to lay it flat on top of the stack S As soon as this occurs the tamping blade 1 is moved up around pivot mechanism 6 away from the stack S so that another sheet E can be deposited on top of the stack S and the operation is repeated.

In the preferred embodiment of the invention, the tamping blade 1 has a permanent magnet 10 therein of a particular polarity which in the drawings has been indicated as being of positive polarity. The permanent magnet 10 is shown as being flat and elongated for convenience of illustration. However, the permanent magnet 10 may assume different shapes and sizes without departing from the invention. In the drawings, a single magnet 10 has been shown, however, it will be understood that several magnets 10 may be disposed along the length of the blade 1 at special intervals or a single magnet 10 may extend along substantially the entire length of the blade. A magnetic wheel or cylinder 11 is rotatably mounted adjacent the top face 4 of the tamping blade 1, i.e. the face of the tamping blade 1 away from the stack S Preferably, the magnetic wheel 10 is a cylinder opposite blade 1. The magnetic wheel or cylinder 11 has a plurality of permanent magnets 12 and 13 spaced from each other around its periphery 14 and is rotated around an axis 15. The polarity of the permanent magnets 12 and 13 are in alternating sequence around the periphery 11 so that a positive polarity magnet 12 is followed by a negative polarity magnet 13 which is followed by a positive polarity magnet 12. The permanent magnets 12 and 13 have been shown as being elongated and approximately the same length as permanent magnet 10 on the blade 1. However, the magnets 12 and 13 may assume different shapes and sizes if desired. The position of the magnets 12 ad 13 around the cylinder 11 are shown as being positioned opposite and adjacent to the permanent magnet 10 on the blade 1. However, all that is necessary is for the magnets 12 and 13 and 10 to be close enough to each other for the magnetic fields of each to react to each other. The magnets 12 and 13 may be single magnets spaced around the perimeter of the cylinder 11 as shown in the drawings or a plurality of axially aligned magnets along the periphery of the cylinder 11 or elongated single magnets extending along substantially the entire length of cylinder 11.

In the drawings, four magnets 12–13 of alternating sequential polarity are shown on the magnet wheel 11.

However, the number of magnets 12–13 on the wheel 11 may be changed without departing from the invention.

The magnetic wheel or cylinder 11 is rotated around its axis 15 so that the permanent magnets 12 and 13 alternately move past the permanent magnet 10 on the tamping blade 1. When the negative permanent magnet 13 in the wheel 11 is adjacent to the positive permanent magnet 10 in the tamping blade 1, the two magnets will attract each other thereby pulling the tamping blade 1 around its pivot 6 away from the stack S and toward the wheel 11 (FIG. 1). The stack S is now free to receive a new sheet P to be deposited thereon. As the wheel 11 continues to rotate the positive permanent magnet 12 in the wheel 11 moves to a position adjacent to the positive magnet 15 in the tamping blade 1. The two magnets now repel each other thereby moving the tamping blade 1 around its pivot 6 away from the wheel 11 and downwardly toward the stack S to strike the top sheet P that has just been deposited on the stack S As the wheel 11 continues to rotate, the next negative permanent magnet 13 again moves adjacent to the positive permanent magnet 10 in the tamping blade 1 in order to pull the tamping blade 1 away from the stack S thereby permitting another sheet P to be placed on top of the stack S. The rotation of the wheel 11 is synchronized with the deposition of a sheet P on top of the stack S so that whenever a sheet P is to be deposited on the stack S, the tamping blade 1 is moved up away from the stack S and after the sheet P is deposited on the stack S, the tamping blade 1 is moved down on top of the stack S.

It will be understood that although the drawings illustrate the permanent magnet 10 on the tamping blade 1 to be positive polarity, it is within the purview of the present invention for the permanent magnet 10 in the tamping blade 1 to be of negative polarity in which event when the positive permanent magnet 12 on the wheel 10 is adjacent the tamping blade 1, it will pivot down over the stack S and when the negative permanent magnet 13 is opposite the tamping blade 1, it is pivoted away from the stack S.

It will also be understood that while permanent magnets 10-12-13 have been disclosed in describing the present invention, electromagnets may also be used without departing from the invention.

Figure 4:
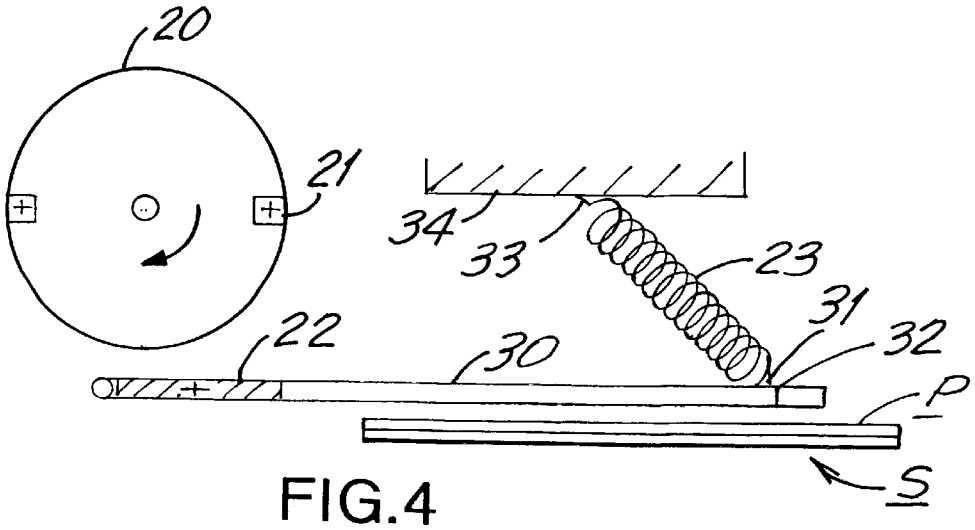
FIG. 4 is a simplified and diagrammatic side view of a modification of the present invention.

FIG. 4 shows another embodiment of the present invention. In this embodiment, the magnetic wheel 20 has permanent magnets 21 of the same polarity as the polarity of the permanent magnet 22 on the tamping blade 30 so that when the two permanent magnets 22 and 21 are adjacent to each other, the tamping blade 30 is pivoted down to flatten the top sheet P onto the stack S. In order to move the tamping blade 30 away from the stack S to permit another sheet P to be deposited on the stack S, spring 23 is provided having one end 31 mounted on the tamping blade 30 at 32 and its other end 33 attached to a frame member 34. When in its normally contracted condition, the spring 23 is biased toward the frame 34 to pull the blade 30 away from the stack S. As soon as the magnets 21 and 22 are adjacent to each other, the magnets 21 and 22 repel each other and the tamping blade 30 is moved down against the bias of the spring 23 thereby stretching the spring 23 to strike the topmost sheet P so that it lays flat on the stack S. When the permanent magnet 21 in the wheel 20 is moved away from the permanent magnet 22 in the tamping blade 30 and the two magnets 21–22 no longer react with each other, the spring 23 will contract to pull the blade 30 away from the stack S. Again, although the drawings show the magnets 21 and 22 being of positive polarity, it is within the purview of the present invention that the permanent magnets 21 and 22 in both the magnetic wheel 20 and the tamping blade 30 to be of negative polarity.

It will thus be seen that the present invention provides an improved paper tamping mechanism which assures that the top sheet deposited on a stack will be tamped down to lie flat on the stack which operates with a minimum of moving parts and which is simple to operate and inexpensive to manufacture.

An many varied modifications of the subject matter of this invention will become apparent to those skilled in the art from the detailed description given hereinabove, it will be understood that the present invention is limited only an provided in the claims appended hereto.

The embodiments of the invention in which an exclusive property or privilege is claimed are defined as follows:

1. A paper tamping mechanism comprising means of depositing sheets in a stack, tamping means adjacent to the stack, magnetic moving means for moving said tamping means towards said stack in order to strike and tamp a sheet deposited on the stack, means for moving the tamping means away from the stack after the sheet has been struck, said tamping means comprising a tamping blade, said tamping blade having a front edge, a rear edge and is pivotally mounted on its rear edge to move toward and away from the stack, said magnetic moving means comprises first magnetic means mounted on said tamping blade.

2. A mechanism as set forth in claim 1 wherein said magnetic moving means comprises second magnetic means adjacent to said tamping blade and wherein means are provided to move said second magnetic means relative to said first magnetic means.

3. A mechanism as set forth in claim 2 wherein said second magnetic means comprises a plurality of magnets whereby said moving means move said plurality of magnets relative to and into reactive relationship with said first magnetic means.

4. A mechanism as set forth in claim 3 wherein said moving means move said plurality of magnets seriatim relative to and into reactive relationship with said first magnetic means.

5. A mechanism as set forth in claim 4 wherein said moving means move the plurality of magnets into relative relationships with said first magnetic means.

6. A mechanism as set forth in claim 5 wherein said plurality of magnets are of different polarity whereby movement of a magnet similar to the polarity of the magnet in the tamping blade to a position adjacent the tamping blade will move the tamping blade away from said stack and whereby movement of a magnet with a polarity different than the polarity of the magnet in the tamping blade adjacent the tamping blade will move the tamping blade towards the stack.

7. A mechanism as set forth in claim 6 wherein said second magnetic means comprises magnets of alternating positive and negative polarities.

8. A mechanism as set forth in claim 7 wherein said moving means is a wheel mechanism having said plurality of magnets thereon.

9. A mechanism as set forth in claim 8 wherein said wheel is a cylinder having said plurality of magnets thereon.

10. A mechanism as set forth in claim 9 wherein said magnets are on the periphery of said wall.

11. A mechanism as set forth in claim 10 wherein said blade is elongated and wherein said first magnet is mounted adjacent the rear edge of said blade.

12. A mechanism as shown in claim 11 wherein said first and second magnetic means are permanent magnets.

13. A mechanism as set forth in claim 5 wherein said plurality of magnets are of the same polarity.

14. A mechanism as set forth in claim 13 wherein the polarity of the said plurality of magnets is the same as the polarity of the said first magnet.

15. A mechanism as set forth in claim 14 wherein spring means are provided to move the blade away from the stack after the magnets have been moved out of magnetic reaction to each other.

16. A mechanism as set forth in claim 15 wherein said spring means comprises a coil spring which is compressible and expandable; one end of the coil spring being mounted on said tamping blade and the other end being mounted on a portion of said mechanism.

17. A mechanism as set forth in claim 16 wherein said moving means is a wheel mechanism having said plurality of magnets thereon.

18. A mechanism as set forth in claim 17 wherein said wheel is a cylinder having said plurality of magnets thereon.

19. A mechanism as set forth in claim 18 wherein said magnets are on the periphery of said wheel.

20. A mechanism as set forth in claim 19 wherein said blade is elongated and wherein said first magnet is mounted adjacent the rear edge of said blade.

21. A mechanism as shown in claim 20 wherein said first and second magnetic means are permanent magnets.

* * * * *